US009117422B2

(12) United States Patent
Kinnaird

(10) Patent No.: US 9,117,422 B2
(45) Date of Patent: Aug. 25, 2015

(54) BAGPIPE DRONE REED

(71) Applicant: Robert Kinnaird, Saskatoon (CA)

(72) Inventor: Robert Kinnaird, Saskatoon (CA)

( * ) Notice: Subject to any disclaimer, the term of this patent is extended or adjusted under 35 U.S.C. 154(b) by 0 days.

(21) Appl. No.: 14/252,338

(22) Filed: Apr. 14, 2014

(65) Prior Publication Data

US 2014/0331849 A1 Nov. 13, 2014

(30) Foreign Application Priority Data

May 8, 2013 (CA) ..... 2815303

(51) Int. Cl.
*G10D 7/06* (2006.01)
*G10D 9/02* (2006.01)

(52) U.S. Cl.
CPC ..... *G10D 9/023* (2013.01)

(58) Field of Classification Search
CPC ..... G10D 7/063; G10D 7/03
See application file for complete search history.

(56) References Cited

U.S. PATENT DOCUMENTS

| | | | | | |
|---|---|---|---|---|---|
| 2,233,507 | A * | 3/1941 | Adamson | 84/380 B |
| 3,476,006 | A * | 11/1969 | Wright | 84/375 |
| 5,959,226 | A * | 9/1999 | Wygent | 84/380 B |
| 6,476,301 | B1 * | 11/2002 | Hepburn | 84/380 B |
| 7,615,699 | B1 * | 11/2009 | McNulty | 84/380 B |
| 2003/0075035 | A1 * | 4/2003 | Ross et al. | 84/380 B |
| 2014/0331849 | A1 * | 11/2014 | Kinnaird | 84/380 B |

FOREIGN PATENT DOCUMENTS

| | | | |
|---|---|---|---|
| DE | 202004018696 | U1 * | 4/2005 |
| DE | 202004018696 | | 7/2005 |
| ES | 1073407 | U * | 12/2010 |
| ES | 2396903 | A2 * | 2/2011 |
| GB | 2341968 | | 3/2000 |
| GB | 2376559 | A * | 12/2002 |
| GB | 2394593 | | 4/2004 |

* cited by examiner

*Primary Examiner* — Robert W Horn
(74) *Attorney, Agent, or Firm* — Ryan W Dupuis; Kyle R. Satterthwaite; Ade & Company Inc.

(57) ABSTRACT

A bagpipe reed has a tongue adjustor for biasing the reed tongue to adjust the amount of air consumed by the reed without altering the pitch of the reed. The tongue adjustor exerts pressure on the tongue without penetrating either the tongue or the body of the reed. The tongue adjustor may be carried by a tongue retaining collar.

16 Claims, 5 Drawing Sheets

BAGPIPE DRONE REED

This application claims foreign priority benefits from Canadian Patent Application 2,815,303, filed May 8, 2013.

FIELD OF THE INVENTION

This disclosure relates to the field of reeds for wind instruments, particularly to drone reeds for bagpipes.

BACKGROUND

Bagpipes are made in a variety of shapes and sizes. The basic form of a bagpipe includes a chanter, usually equipped with a reed and having up to eight finger holes allowing a melody to be played; an airtight bag; a blowpipe, also known as a blowstick, which is usually equipped with a one-way valve, through which the player blows air into the bag; and one or more drone pipes extending from the bag, each drone pipe fitted with a reed that produces a tuned sound to harmonize with the melody produced by the chanter.

Traditionally, bagpipe reeds have been made from natural materials, such as cane or bamboo, but more recently synthetic reeds have been produced from materials such as plastics, wood, composites, polymers, and light alloy metals such as aluminum and brass. The basic form of a bagpipe drone reed is a hollow tube body, sealed at one end and open at the other end, with a bleed aperture passing through the wall of the tube. A tongue is attached at one end to the body, with the free end of the tongue extending over the bleed aperture and free to vibrate in response to air flow through the bleed aperture. The effective length of the tongue may be altered by moving a bridle along the length of the body of the reed, altering the length of the portion of the tongue that is free to vibrate in response to air flow through the bleed aperture. The bridle is typically a loop or ring of material, such as a loop of cord, rubber, or a rubber O-ring, that snugly encircles the body of the reed and the tongue. Shortening the effective length of the tongue raises the pitch of the reed, while increasing the effective length of the tongue lowers the pitch of the reed. The reed may further include a pitch adjuster at the sealed end to allow for additional tuning to bring the reed optimally in tune with the instrument.

To enable vibration of the tongue, there must be a space or gap between the underside of the tongue and the upper edges of the bleed aperture. This may be provided by a curvature in the tongue, in a portion of the reed body underlying the tongue, or in both the tongue and in a portion of the reed body underlying the tongue. The distance between the underside of the tongue and the upper edges of the bleed aperture determines the amount of air consumed by the reed. Individual players have different airflow requirements, with some players requiring what is referred to as soft reed allowing relatively low airflow and other players requiring what is referred to a hard reed allowing relatively high airflow. It is desirable that the airflow of the reed be adjustable to allow for optimization of the reed for individual players. Typically the gap between the tongue and reed body would range between about 0.2 mm and about 0.5 mm, depending on the reed and material of the tongue. The stiffer the tongue material, the smaller the gap required for the same amount of airflow into the reed.

GB2394593 discloses a reed body having a screw that can be used to adjust the curvature of the body of the reed and the divergence from the tongue and the reed body, thereby determining the pitch of the reed. Curving the body of the reed allows the airflow to be adjusted while simultaneously adjusting the pitch of the sound produced by the reed. GB2341968 discloses a reed body comprising one or a pair of bleed orifices, each orifice covered by a tongue, wherein each tongue is curved away from the body of the reed, or the tongue is planar and the reed body is machined to introduce a gap between the tongue and the reed body. Further, the tongue(s) on this reed are reversible allowing them to be used in either the traditional orientation with the tongue secured to the reed body towards the end of the reed body that is closest to the drone or in the inverted orientation, with the free end of the tongue towards the end of the reed body that is closest to the drone. Inverted reeds are thought to have better strike-in than traditionally oriented reeds and may have slightly different sound quality than traditionally oriented reeds. Neither of these designs allows the airflow of the reed to be adjusted independent of the pitch, making it challenging to adjust the reed to match the airflow requirements of the player and the pitch requirements of the instrument.

Another reed design is set forth in DE202004018696. In this design, the tongue is secured to the reed body by a pair of screws and the curvature of the tongue is adjustable by exerting or reducing pressure on a leaf spring overlying the tongue by tightening or loosening one of the screws. This allows for the airflow of the reed to be adjusted independent of pitch, but precludes use of the tongue in the traditional orientation.

While each of the bagpipe reeds discussed above is suitable for its intended purpose, there remains a desire in the art for a bagpipe reed with adjustable airflow that is simply adjusted and readily tunable.

SUMMARY OF THE INVENTION

According to one aspect of the invention there is provided a bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction; a tongue having an upper face and a lower face, said tongue seated on the tongue seating portion of the body and overlying both the tongue receiving depression and the bleed aperture; and a tongue adjustor movable to apply pressure to the upper face of the tongue within a portion of the tongue overlying the tongue receiving depression, said tongue adjustor maintained outside the body of the reed, wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

According to another aspect of the present invention there is provided a bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction;

a tongue having an upper face and a lower face, said tongue seated on the tongue seating portion of the body and overlying both the tongue receiving depression and the bleed aperture; and a tongue adjustor movable to apply pressure to the upper face of the tongue within a portion of the tongue overlying the tongue receiving depression, said tongue adjustor engaging the tongue in a non-penetrating manner, wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

The tongue receiving depression may be positioned closer to the open end of the body than is the bleed aperture.

The tongue receiving depression may be located on an exterior surface of the body overlying the hollow interior portion of the body.

The tongue adjustor may be carried by a collar, said collar being arranged to receive the portion of the body that comprises the tongue receiving depression.

The collar may comprise a tongue receiving channel for receiving the tongue and inhibiting lateral movement of the tongue when said tongue is received within the tongue receiving channel.

The collar may comprise a collar positioning member arranged to engage the body and enable positioning of the collar at a predetermined position relative to the length of the body.

The collar may comprise a tongue seat engaging portion for engaging the tongue seat and thereby preventing rotation of the collar about the longitudinal axis of the reed body.

The tongue adjustor may be a threaded member, for example a threaded member that passes through a wall of the collar. More particularly, the threaded member is a precision screw.

The tongue adjustor may alternatively comprise a cam.

Preferably the tongue is a solid tongue devoid of apertures.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figures 1, 2:
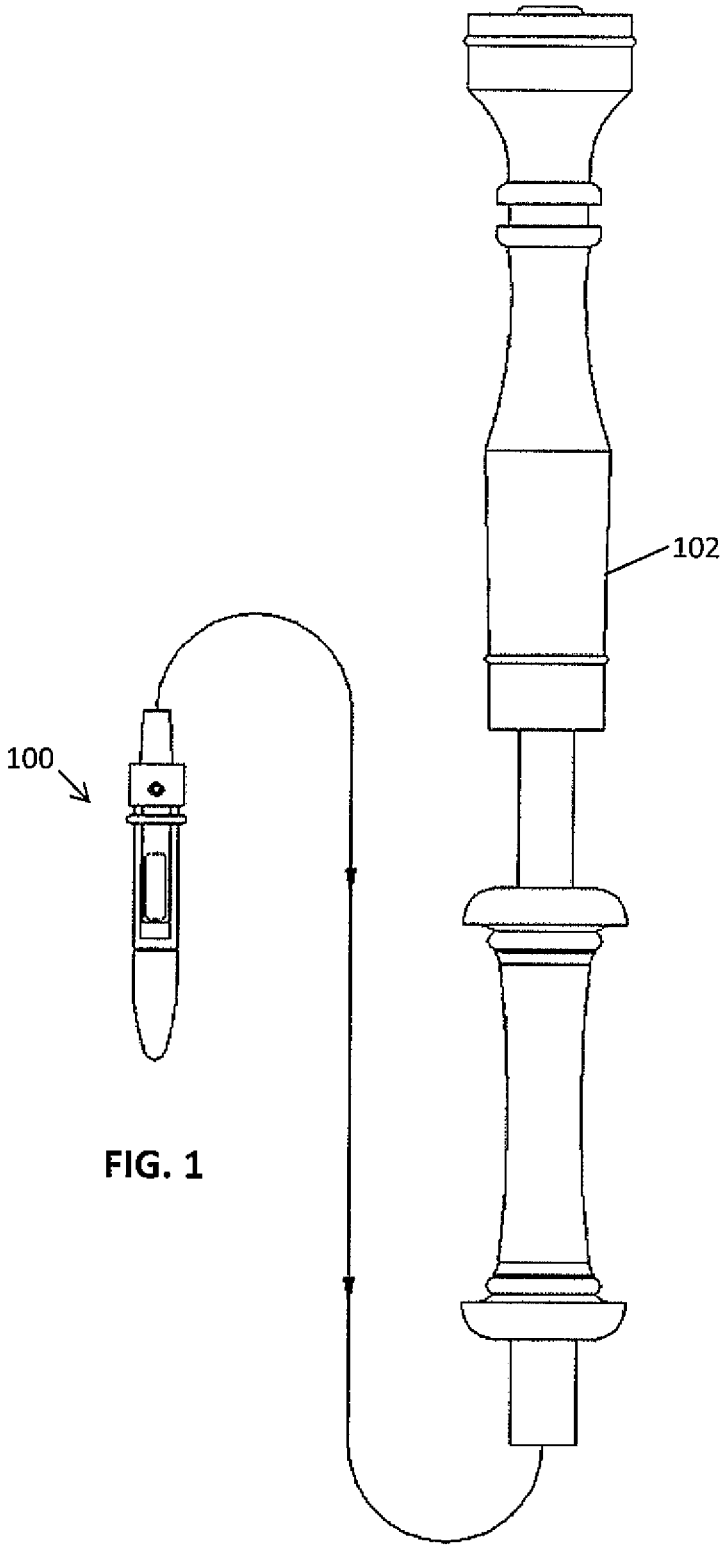
FIG. 1 depicts a top plan view of an embodiment of a bagpipe reed of the disclosure.
FIG. 2 depicts a bagpipe drone.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. Further, where considered appropriate, reference numerals may be repeated among the figures to indicate corresponding or analogous elements.

Figure 5:
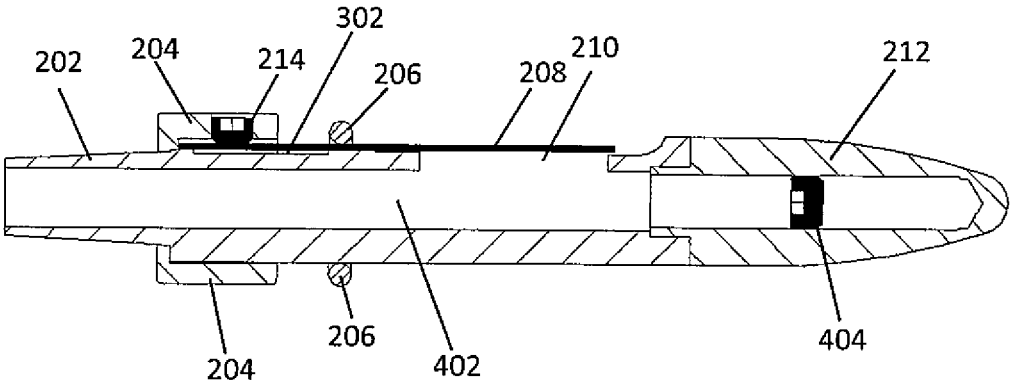
FIG. 5 depicts a sectional view of the bagpipe reed of FIG. 1, sectioned in the direction of and along line A as shown in FIG. 3, with the tongue in a first position.
Figure 6:
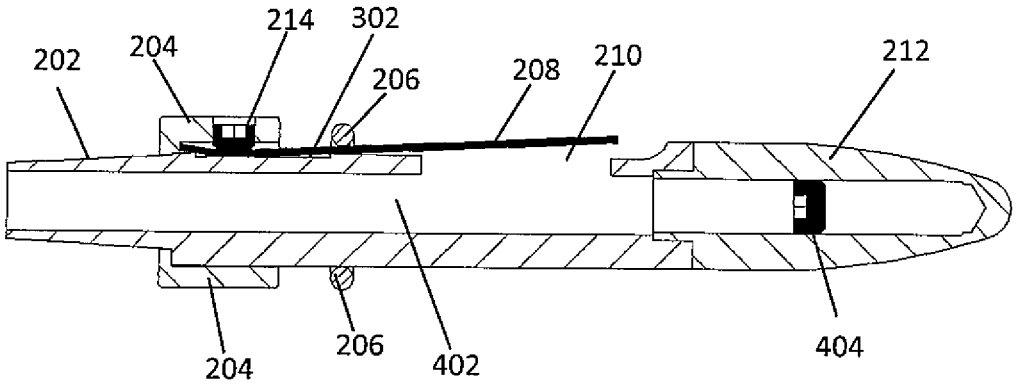
FIG. 6 depicts a sectional view of the bagpipe reed of FIG. 1, sectioned in the direction of and along line A as shown in FIG. 3, with the tongue in a second position.
Figure 7:
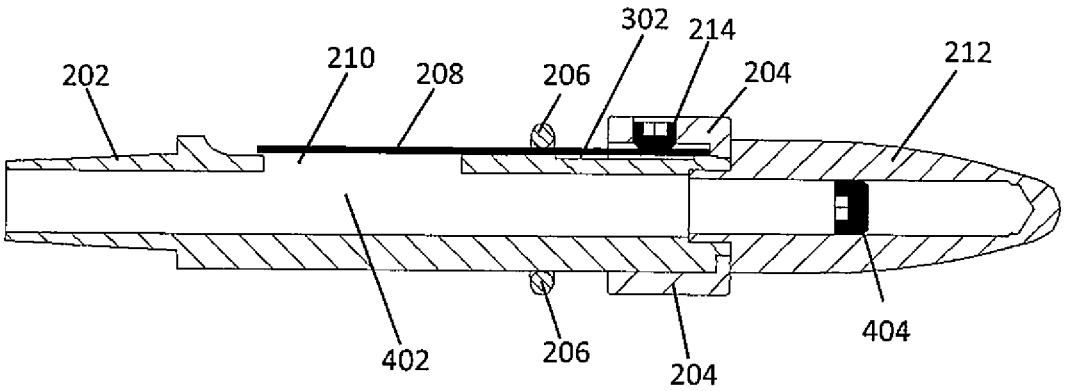
FIG. 7 depicts a sectional view of a bagpipe reed with the tongue mounted in the inverted orientation.

An embodiment of a bagpipe reed of the disclosure is depicted in FIGS. 1, 3, 4, 5, and 6. A second embodiment of a bagpipe reed of the disclosure is depicted in FIG. 7. The reed 100 comprises a reed body 200 and a tongue 208. The reed body 200 is substantially tubular having an open end and a closed end, with a hollow chamber 402 extending from the open end to the closed end. An exterior side of the reed body 200 comprises a substantially planar surface portion that is a tongue seating portion which allows a tongue 208 to be seated on the reed body 200. The part of the tongue seating portion that is in contact with the underside of the tongue 208, when said tongue 208 is seated on the reed body 200, is referred to herein as a tongue seat. The reed body 200 further comprises an elongated bleed aperture 210 that passes through the wall of the reed body 200 and is in communication with the hollow chamber 402 within the reed body 200. The hollow chamber 402 allows air to flow through the reed body 200, with air entering from the bag of the bagpipe through the bleed aperture 210 and exiting through the tenon 202 into the drone 102. The tongue 208 overlies the bleed aperture 210 and is substantially planar, though the tongue 208 may optionally comprise a slight curvature along its longitudinal axis to maintain the tongue 208 slightly elevated above the edges of the bleed aperture 210. When the instrument is played, air passes under the tongue 208, through the bleed aperture 210 and into the hollow chamber 402 of the reed body 200, pulling the tongue 208 towards the edges of the bleed aperture 210 and causing the tongue 208 to vibrate, thereby controlling airflow into the instrument and producing sound.

The reed body 200 may be made of any suitable material as will be understood to one skilled in the art. Examples of suitable reed body 200 materials include, but are not limited to; plastic, wood, composite, aluminum, and brass. Similarly, the tongue 208 may be made of any suitable material as will be understood to one skilled in the art. Examples of suitable tongue materials include, but are not limited to; carbon fibre, glass fibre, plastic, wood, cane, bamboo, aluminum, and brass.

Figure 3:
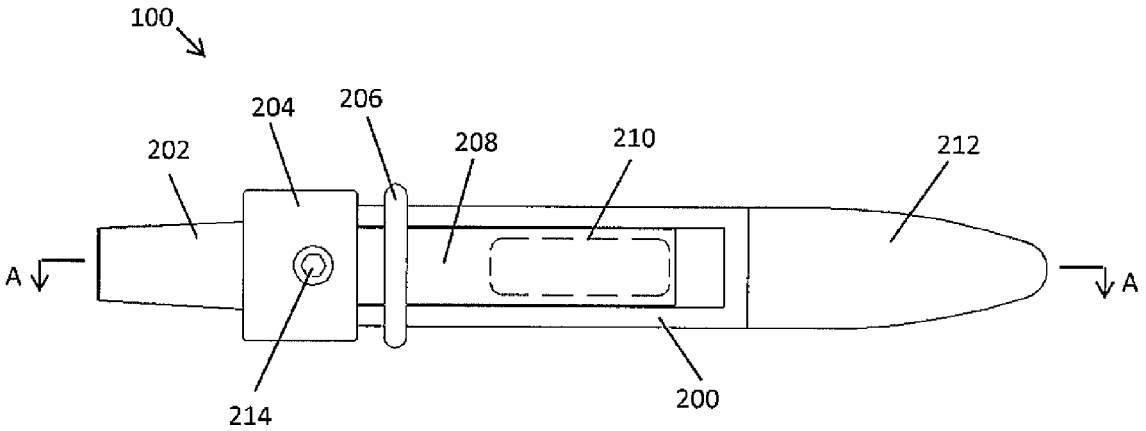
FIG. 3 depicts a top plan view of the bagpipe reed of FIG. 1.
Figure 4:
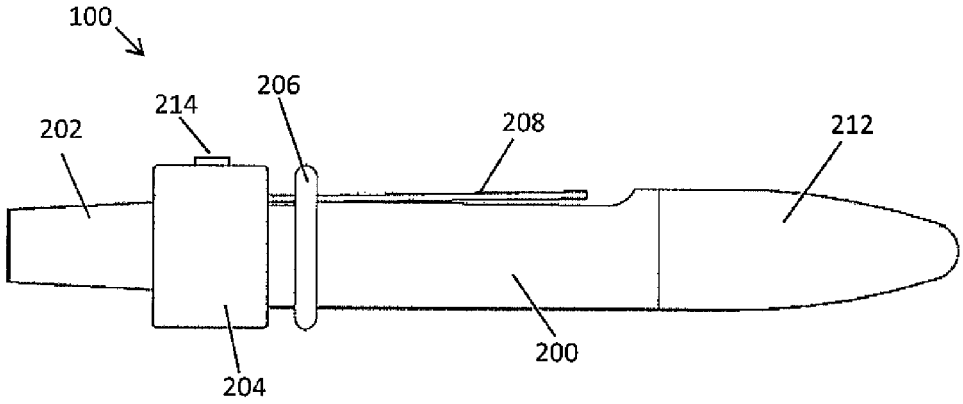
FIG. 4 depicts a side elevation view of the bagpipe reed of FIG. 1.

The pitch of the sound produced by the reed 100 can be adjusted by altering the effective length of the tongue 208. To assist such adjustment, the reed 100 may optionally comprise a bridle 206. The bridle 206 encircles the reed body 200 and applies pressure to the tongue 208, bringing the portion of the tongue 208 that is in contact with the bridle 206 into contact with the reed body 200 and thereby anchoring the portion of the tongue 208 that is in contact with the bridle 206 to the reed body 200; altering the length of the portion of the tongue 208 that is elevated from the reed body 200 and therefore free to vibrate to produce sound. With the reed oriented as shown in FIG. 3, the portion of the tongue 208 that is to the right of the bridle 206 is free to vibrate. Moving the bridle 206 to the right would shorten the effective length of the tongue 208 and raise the pitch of sound produced by the reed 100, while moving the bridle 206 to the left would increase the effective length of the tongue 208 thereby lowering the pitch of the sound produced by the reed 100. Changing the position of the bridle 206 also adjusts the amount of air consumed by the reed 100. For a reed 100 in the orientation shown in FIGS. 3 and 4, moving the bridle 206 to the left would increase the gap between the tongue 208 and the edges of the bleed aperture 210, thereby increasing air consumption by the reed 100 while moving the bridle 206 to the right would decrease the gap between the tongue 208 and the edges of the bleed aperture 210 thereby decreasing air consumption by the reed 100.

A disadvantage of using the position of a bridle 206 to adjust the airflow of the reed 100 is that this does not allow the airflow to be adjusted independently of the pitch. Accordingly, in a non-illustrated embodiment, the reed 100 does not comprise a bridle 206.

The reed 100 further comprises a tenon 202 at the open end of the reed body 200 for inserting the reed 100 into a reed seat of a drone 102. The reed 100 may further comprise hemping or another material, such as a waxed cord or a rubber sleeve, wrapped around the tenon 202 to enable the reed 100 to form an airtight seal with the reed seat of the drone 102. The closed end of the reed 100, which is the end opposite the tenon 202, comprises a tuning screw 404, optionally housed within a housing 212. In other embodiments, the reed 100 may comprise another type of tuning adjustor, such as an adjustable tuning plug, in place of the tuning screw; or the reed 100 may instead comprise a fixed end without a tuning adjustor. When the reed is equipped with a tuning screw 404, the tuning screw 404 allows a user to alter the pitch of the sound produced by the reed 100 by adjusting the length of the hollow chamber 402 within the reed body 200. This can be accomplished by adjusting the position of the tuning screw 404 to shorten or increase the length of the hollow chamber 402. Shortening the hollow chamber 402 increases the pitch of the sound produced by the reed 100 while lengthening the hollow chamber 402 decreases the pitch of the sound produced by the reed 100.

In an embodiment, the reed 100 further comprises a tongue retaining collar 204 comprising a tongue adjustor 214. The tongue retaining collar 204 is arranged to encircle a portion of the reed body 200 while overlying an end portion of the tongue 208, thereby maintaining the tongue adjustor 214 over the end portion of the tongue 208. Further, the reed body 200 comprises a tongue receiving depression 302 that is located within the tongue seating portion of the reed body 200, flanked longitudinally by the tongue seat, and recessed relative to said tongue seat. The tongue receiving depression 302 is positioned to underlie the tongue adjustor 214 and is longitudinally spaced apart from the bleed aperture 210, with a portion of the tongue seat positioned between the tongue receiving depression 302 and the bleed aperture 210.

The tongue adjustor 214 is movable inwardly relative to the reed body 200, such that movement of the tongue adjustor 214 towards the reed body 200 applies pressure to the upper surface of the portion of the tongue 208 overlying the tongue receiving depression 302, urging said portion of the tongue 208 towards the surface of the reed body 200 and into the tongue receiving depression 302. As pressure is applied to the tongue 208 by the tongue adjustor 214, the portion of the tongue seat that is situated between the depression 302 and the bleed aperture 210 acts as a fulcrum, causing the end of the tongue 208 overlying the bleed aperture 210 to move upwards away from the edges of the bleed aperture 210; increasing the distance between the underside of the tongue 208 and the edges of the bleed aperture 210 and consequently increasing the air consumption of the reed 100. Conversely, the tongue adjustor 214 may be moved outwardly relative to the reed body 200 to reduce pressure on the upper surface of the tongue 208, thereby reducing the distance between the underside of the tongue 208 and the upper edges of the bleed aperture 210. A comparison of the reed 100 with the tongue 208 in an unbiased position and with the tongue 208 biased due to pressure from the tongue adjustor 214 is shown in FIGS. 5 and 6.

In an embodiment, the bore of the tongue retaining collar 204 is slightly smaller than the outer diameter of the reed body 200, allowing the tongue retaining collar 204 to receive the reed body 200 in a friction fit. The tongue retaining collar 204 may be made of any suitable material as will be understood to one skilled in the art. Examples of suitable tongue retaining collar 204 materials include, but are not limited to; plastic, aluminum, and brass.

Figure 8:
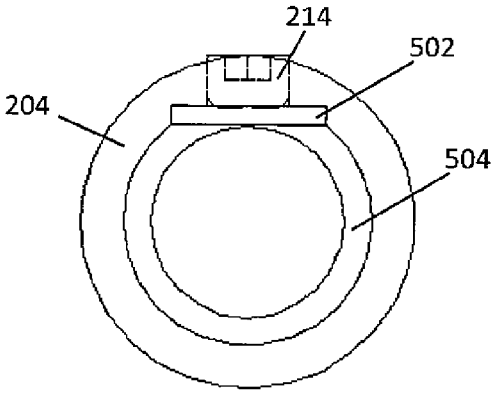
FIG. 8 depicts a front end view of an embodiment of a tongue retaining collar.
Figure 9:
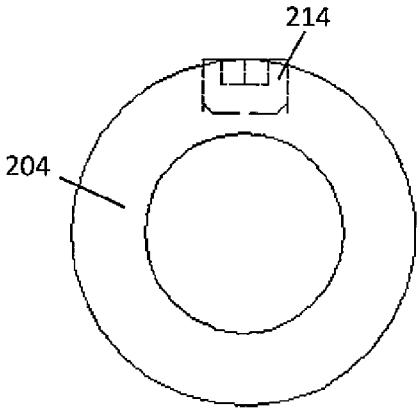
FIG. 9 depicts a rear end view of the tongue retaining collar of FIG. 8.
Figure 10:
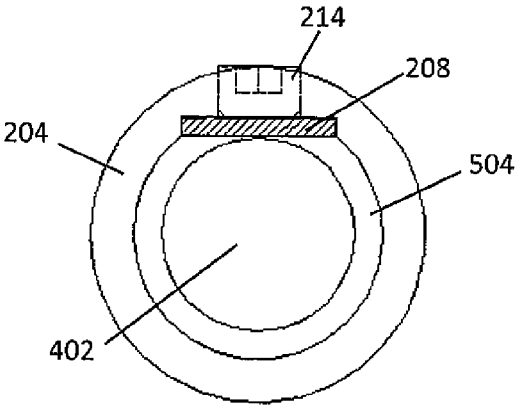
FIG. 10 depicts a partial front end view of the tongue retaining collar of FIG. 8 in combination with a tongue.

In the embodiments depicted in FIGS. 8 to 10, the tongue adjustor 214 is a set screw, though another type of pressure applying member could be employed, so long as the pressure applying member allows pressure to be applied locally to the portion of the tongue 208 overlying the tongue receiving depression 302 and the pressure applying member is finely adjustable to allow a user to adjust the gap between the underside of the tongue 208 and the edges of the bleed aperture 210 in sub-millimeter increments.

Figure 11:
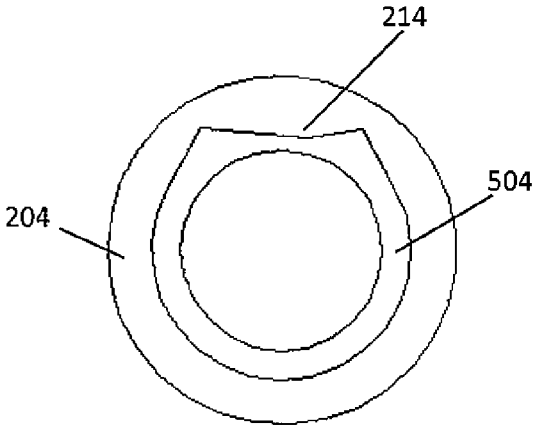
FIG. 11 depicts a second embodiment of a tongue retaining collar.
Figure 12:
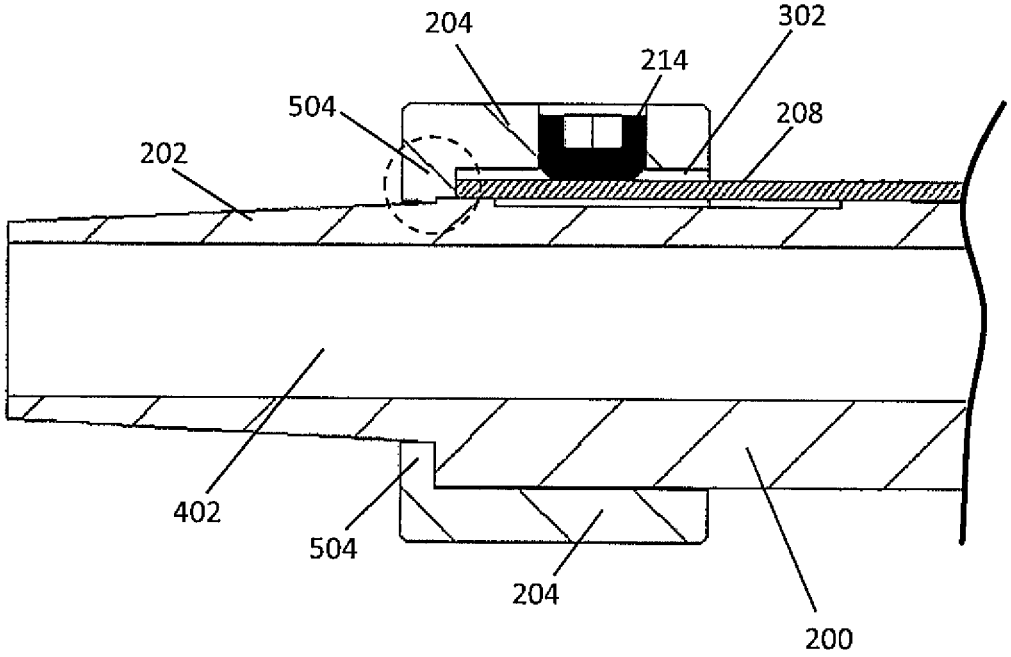
FIG. 12 depicts a sectional view of the collar of FIG. 8 in combination with a reed.

A second embodiment of a collar 204 and tongue adjustor 214 is depicted in FIG. 11. In this embodiment, the collar 204 comprises a rotating cam that can be used to apply pressure to the upper face of the tongue 208, said pressure adjustable by rotation of the collar 204 about the longitudinal axis of the reed body 200. To prevent unwanted rotation, the collar 204 may receive the reed body 200 in a friction fit, wherein the collar 204 is held in position by frictional engagement between the collar 204 and the reed body 200. The collar 204 may also comprise a locking mechanism to prevent further rotation of the collar 204 once the tongue adjustor 214 is in the desired position.

Further, in a non-illustrated embodiment, the tongue adjustor 214 may be maintained over the upper face of the tongue 208 by a support structure other than a collar, such as a partial collar or support arm. In all embodiments, the tongue adjustor 214 is maintained outside of the reed body 200 and penetrates neither the tongue 208 nor the reed body 200.

In the embodiment depicted in FIGS. 1 and 3-6, the tongue retaining collar 204 is shown overlying the end of the tongue 208 that is proximal to the open end of the reed body 200. In another embodiment, depicted in FIG. 7, the tongue adjustor 214 overlies the end of the tongue 208 that is proximal to the closed end of the reed body 200, thereby allowing the tongue 208 to be positioned in the inverted orientation. In this embodiment, the tongue receiving depression 302 is also located proximal to the closed end of the reed body 200.

An embodiment of a tongue retaining collar 204 is further detailed in FIGS. 8 to 10 and 12. With reference to the embodiment shown in FIGS. 1-6, the front end of the tongue retaining collar 204, shown in FIG. 8, is the end of the collar that faces the closed end of the reed body 200, comprising the housing 212, while the rear end of the tongue retaining collar 204, shown in FIG. 9, is the end of the collar that faces the open end of the reed body 200, comprising the tenon 202. In an embodiment, the tongue retaining collar 204 comprises a channel 502 that is arranged to receive the tongue 208. The channel 502 extends along a substantial portion of the length of the collar 204, extending from the front end of the collar 204 to a collar positioning member 504 at the rear end of the collar 204. In an embodiment, the cylindrical bore of the tongue retaining collar 204 is of substantially uniform diameter along most of the length of the collar 204 extending from the front end of the collar 204 towards the rear end of the collar 204. However, the bore at the rear end of the collar 204 may be of a smaller diameter, forming a collar positioning lip 504 that is arranged to engage the reed body 200 at the intersection between the reed body 200 and the tenon 202. The engagement between the collar positioning lip 504 of the tongue retaining collar 204 and the reed body 200 allows the tongue retaining collar 204 to be consistently positioned by a user in a predetermined position overlying the tongue receiving depression 302. This allows the tongue retaining collar 204 to be removed from the reed 100 and returned to the reed 100 by a user while enabling consistent positioning of the tongue adjustor 214 relative to the tongue 208 and the tongue receiving depression 302. The lip 504 further allows for consistent positioning of the tongue 208 relative to the collar 204 and consequently the tongue adjustor 214, since the tongue 208 can be reliably positioned by a user through engagement with the lip 504. The relative positioning of the tongue 208, tongue adjustor 214, and tongue receiving depression 302 ensures that the effective length of the tongue 208 will remain consistent. In another embodiment of the tongue retaining collar 204, lip 504 is absent and the bore of the collar is substantially constant along the length of the tongue retaining collar 204. In other embodiments, the collar positioning member 504 may be a tab or other member that engages the reed body 200 to position the collar 204 at a predetermined position relative to the length of the reed body 200.

Figure 13:
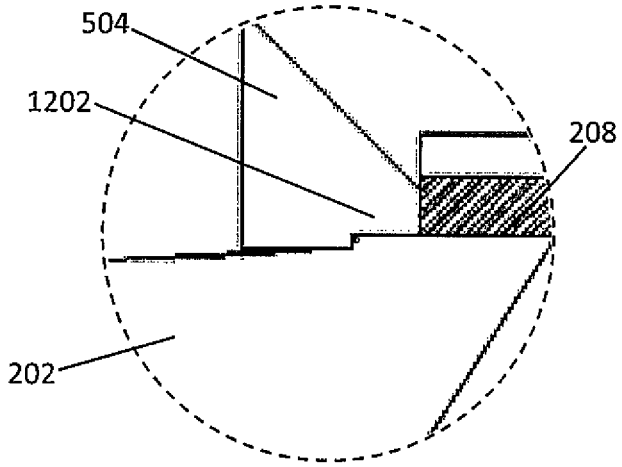
FIG. 13 depicts an enlarged view of a portion of FIG. 12.

The collar 204 may further comprise a tongue seat engaging portion 1202. The tongue seat engaging portion 1202 is a portion of the collar 204 that is arranged to engage a portion of the tongue seat, thereby preventing rotation of the collar 204 about the longitudinal axis of the reed body 200, as detailed in FIGS. 12 and 13. In an embodiment, the tongue seat engaging portion 1202 is substantially planar, allowing said portion 1202 to sit flat against the upper surface of the tongue seat. In a further embodiment, the tongue seat engaging portion 1202 of the collar 204 engages the tongue seat adjacent to the end of the tongue 208.

The primary function of the tongue adjustor 214, as described above, is to allow a user to apply pressure to the upper surface of the portion of the tongue 208 overlying the tongue receiving depression 302, thereby biasing the tongue 208 and increasing the gap between the underside of the tongue 208 and the edges of bleed aperture 210. A secondary function of the tongue adjustor 214 is to maintain the tongue 208 seated on the reed body 200. The tongue adjustor 214 may be positioned to exert sufficient pressure on the tongue 208 to keep the tongue 208 engaged with the reed body 200 without significantly increasing the gap between the underside of the tongue 208 and the edges of bleed aperture 210. This enables the reed 100 to be used without a bridle 206, since the tongue adjustor 214 holds the tongue 208 seated on the tongue seat; a function traditionally performed by the bridle 206. A user may wish to use a bridle 206 with the reed 100 in order to provide an additional means of pitch adjustment, but this is optional.

In an embodiment depicted in FIGS. 8 and 10, the tongue retaining collar 204 comprises a channel 502 that is arranged to receive the tongue 208. The channel 502 extends along a substantial portion of the length of the tongue retaining collar 204 and is arranged to receive the tongue 208. The channel 502 helps to retain the tongue 208 within the tongue retaining collar 204 and further engages the side edges of the tongue 208 to inhibit lateral movement of the tongue 208, keeping the tongue 208 aligned overtop of the bleed aperture 210.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments.

Further, while the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting. It will be understood by persons skilled in the art that other variants and modifications may be made without departing from the scope of the invention as defined in the appended claims.

The invention claimed is:

1. A bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction;

a tongue having an upper face and a lower face, said tongue seated on the tongue seating portion of the body and overlying both the tongue receiving depression and the bleed aperture;

a tongue adjustor movable to apply pressure to the upper face of the tongue within a portion of the tongue overlying the tongue receiving depression;

a collar receiving the tongue seating portion of the body that locates the tongue receiving depression therein, the tongue adjustor being carried by the collar; and a tongue receiving channel in the collar for receiving the tongue and inhibiting lateral movement of the tongue when said tongue is received within the tongue receiving channel, wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

2. The bagpipe reed according to claim 1 wherein the tongue receiving depression is positioned closer to the open end of the body than is the bleed aperture.

3. The bagpipe reed according to claim 1 wherein the tongue receiving depression is located on an exterior surface of the body overlying the hollow interior portion of the body.

4. The bagpipe reed according to claim 1 wherein the tongue adjustor is a threaded member.

5. The bagpipe reed according to claim 1 wherein the collar comprises a collar positioning member arranged to engage the body and enable positioning of the collar at a predetermined position relative to the length of the body.

6. The bagpipe reed according to claim 1 wherein the tongue adjustor is a threaded member that passes through a wall of the collar.

7. The bagpipe reed according to claim 1 wherein the tongue is a solid tongue devoid of apertures.

8. A bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction;

a tongue having an upper face and a lower face, said tongue seated on the tongue seating portion of the body and overlying both the tongue receiving depression and the bleed aperture;

a tongue adjustor movable to apply pressure to the upper face of the tongue within a portion of the tongue overlying the tongue receiving depression;

a collar receiving the tongue seating portion of the body that locates the tongue receiving depression therein, the tongue adjustor being carried by the collar; and a tongue seat engaging portion on the collar for engaging the tongue seat and thereby preventing rotation of the collar about the longitudinal axis of the reed body, wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

9. A bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction;

a tongue having an upper face and a lower face, said tongue seated on the tongue seating portion of the body and overlying both the tongue receiving depression and the bleed aperture;

a tongue adjustor movable to apply pressure to the upper face of the tongue within a portion of the tongue overlying the tongue receiving depression; and a collar receiving the tongue seating portion of the body that locates the tongue receiving depression therein, the tongue adjustor being carried by the collar;

wherein the tongue adjustor comprises a cam; and wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

10. A bagpipe reed comprising:

a body comprising an outer wall, an open end, a closed end, and a hollow interior portion extending from the open end to the closed end, said body further comprising a tongue seating portion on an exterior side of the body, said tongue seating portion comprising a tongue seat;

a bleed aperture passing through the outer wall of the body in communication with the hollow interior portion of the body;

a tongue receiving depression, said tongue receiving depression located within the tongue seating portion of the body and spaced apart from the bleed aperture in the longitudinal direction;

a tongue having an upper face and a lower face, said tongue seated on the tongue seating portion of the body and overlying both the tongue receiving depression and the bleed aperture; and a tongue adjustor movable to apply pressure to the upper face of the tongue within a portion of the tongue overlying the tongue receiving depression;

a collar receiving the tongue seating portion of the body that locates the tongue receiving depression therein, the tongue adjustor being carried by the collar; and a collar positioning member on the collar arranged to engage the body and enable positioning of the collar at a predetermined position relative to the length of the body, wherein pressure applied by the tongue adjustor to the upper face of the tongue forces the portion of the tongue overlying the tongue receiving depression into the tongue receiving depression, thereby biasing a portion of the tongue overlying the bleed aperture away from the edges of the bleed aperture and increasing the distance between the edges of the bleed aperture and the lower face of the tongue.

11. The bagpipe reed according to claim 10 wherein the tongue receiving depression is positioned closer to the open end of the body than is the bleed aperture.

12. The bagpipe reed according to claim 11 wherein the tongue receiving depression is located on an exterior surface of the body overlying the hollow interior portion of the body.

13. The bagpipe reed according to claim 12 wherein the tongue adjustor is a threaded member.

14. The bagpipe reed according to claim 10 wherein the collar comprises a tongue receiving channel for receiving the tongue and inhibiting lateral movement of the tongue when said tongue is received within the tongue receiving channel.

15. The bagpipe reed according to claim 11 wherein the collar comprises a tongue seat engaging portion for engaging the tongue seat and thereby preventing rotation of the collar about the longitudinal axis of the reed body.

16. The bagpipe reed according to claim 12 wherein the tongue is a solid tongue devoid of apertures.

* * * * *